United States Patent [19]

Pirtle et al.

[11] Patent Number: 4,606,194

[45] Date of Patent: Aug. 19, 1986

[54] CRYOCOOLER HAVING LOW MAGNETIC SIGNATURE

[75] Inventors: F. William Pirtle, Stow; Harry G. Nicoll, Norwell; Peter K. Bertsch, Harvard, all of Mass.

[73] Assignee: Helix Technology Corporation, Waltham, Mass.

[21] Appl. No.: 553,368

[22] Filed: Nov. 18, 1983

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 4,143,520 | 3/1979 | Zimmerman | 62/6 |
| 4,281,517 | 8/1981 | Zimmerman et al. | 62/6 |
| 4,365,982 | 12/1982 | Durenec | 62/6 |

OTHER PUBLICATIONS

Sullivan and Zimmerman, 1979 IPC Business Press Ltd, vol 2, No. 6, Nov. 1979, "Very Low-Power Stirling Cryocoolers Using Plastic and Composite Materials".

Zimmerman et al., "Possible Cryocoolers for SQUID Magnetometers", *SQUID Superconducting Quantum Interference Devices and Their Applications,* 1976.

Zimmerman et al., "Referigeration for Small Superconducting Devices", 1976.

Zimmerman et al., "Operation of a SQUID in a Very Low-Power Cryocooler", Conference on Applications of Closed-Cycle Cryocoolers to Small Superconducting Devices, 1978.

Pirtle, F. William, CTI-Cryogenics Report, Nov. 1980, "Closed Cycle Cryocooler for Low Temperature Electronic Circuits", AD AD93416.

Mμ Shield Company Brochure, "Mμ Shield Magnetic Shields", 1978.

*Primary Examiner*—Ronald C. Capossela

*Attorney, Agent, or Firm*—Hamilton, Brook, Smith & Reynolds

[57] ABSTRACT

A cryocooler 8 is described which has a low magnetic signature in which a ceramic displacer 10 reciprocates within a helium impenetrable cold finger cylinder 12. A cyrogenic refrigerator formed by the displacer and the cold finger cylinder cools a cold space 22 to cryogenic temperature. The cold space 22 is magnetically shielded from a drive motor 18 which both drives the displacer 10 and compressor pistons 14, 15, 16. The motor is magnetically shielded by means of magnetic shields 70, 72, 74, 90, 76, 78, 80, 82.

9 Claims, 4 Drawing Figures

CRYOCOOLER HAVING LOW MAGNETIC SIGNATURE

GOVERNMENT SUPPORT

The U.S. government has an interrest in this invention pursuant to contract number N00014-82-C-0326 awarded by the Office of Naval Research, Department of the Navy.

TECHNICAL FIELD

This invention relates to cryogenic refrigerators and particularly to an improved cryocooler for cooling electronic devices to cryogenic temperatures while producing a minimum of magnetic disruption.

BACKGROUND

A primary application for cryocoolers is with superconducting electronic devices. Superconductive electronic devices offer many advantages in terms of reduced power requirements, weight and size over conventional electronic devices. The phenomenon of superconductivity, however, only occurs at very low temperatures, usually within 20° C. of absolute zero. It is for this reason that superconductor devices are conventionally cooled with liquid helium.

Superconductivity is characterized by a drastic reduction of electrical resistance in materials below a certain transition temperature. Above this temperature, superconductor material behaves conventionally and is said to be in the normal state. In their superconducting state, superconducting materials pass electrical currents very quickly and without the generation of heat because their electrical resistance is nearly zero. Superconducting devices, therefore, are able to transmit large amounts of energy without the losses which occur in conventional conductors such as copper. A corollary to this ability is the capability of some superconducting devices to detect minute amounts of electromagnetic energy that would be imperceptible with conventional devices.

A further property of many superconductor devices is their extreme sensitivity to magnetic radiation. Large magnetic fields not only can disrupt the output of superconductor devices but can cause them to revert to their conventional state. Therefore, superconductor devices must be operated at very low temperatures and in low magnetic fields.

A considerable number of superconductor devices with uniquely useful properties and a large range of potential applications have appeared over the last few years. Superconducting bolometers are capable of temperature measurements of a far more sensitive character than conventional devices. Similarly, superconducting Schottky diodes react much faster and produce far less heat than conventional room temperature diodes. Further, Josephson junction devices have, among numerous other applications, a prospective use as miniaturized computer logic elements.

Superconducting quantum interference devices (SQUID's) have been found to be among the most useful superconductor devices. They have been used as extremely sensitive magnetometers, galvanometers, susceptibility meters, radio frequency power meters and communication receivers. These SQUID devices are used in significant numbers by scientists in geology, medical research, and in the military. In all such uses, the users accept the inconvenience and cost of a liquid helium cryostat cooling system because the SQUID devices are simpler and more sensitive by several orders of magnitude than comparable conventional instruments.

Another electronic application requiring cryogenic cooling is operation of infrared (IR) radiation detectors. Heat energy masks the IR signal of faint or distant IR sources. The sensitivity of IR detectors is therefore greatly improved at cryogenic temperatures. Recently an expensive and highly successful American research satellite with an IR detector was abandoned due to the complete consumption of its liquid helium supply by its cryostat. Use of a low power cryocooler instead of a cryostat might have extended the life of this expensive satellite.

Liquid helium cryostats are inconvenient and expensive to use. This is because liquid helium is not readily available at many locations and, in all cases, must be carefully handled and secured. Further, liquid helium cryostats must be periodically serviced and replenished. The cost, inconvenience and attendant restrictions on cryostat cooled instruments are primary disadvantages in competition with conventional devices. If a way could be found to eliminate liquid helium cryostats, low temperature and superconducting electronic devices could be more widely utilized.

A cryocooler designed to replace conventional cryostats used with superconducting devices is described in U.S. Pat. No. 4,143,520 to Zimmerman. Zimmerman discloses a Stirling cycle cryogenic cooler with a nylon annular displacer housed in a glass reinforced plastic cylinder. Zimmerman utilizes these materials in order to give his device a low magnetic signature compatible with SQUID devices.

In the Zimmerman device, helium gas is driven between the displacer and the cylinder to form a gap regenerator between the helium source and the cold cylinder tip at cryogenic temperatures. While this represents an improved apparatus for cooling electronic devices, it has some practical disadvantages. A primary disadvantage is that the plastic and nylon material of the refrigerator are permeable to helium. Zimmerman's system therefore leaks helium from the gap regenerator over a period of time. This requires periodic recharging of the cryocooler. Also, the volume surrounding the refrigerator cylinder is held at a vacuum to minimize thermal leakage. With leakage of helium into that volume, the thermal leak increases unless a pump is used to maintain the vacuum. The plastic used by Zimmerman also has a tendency to appreciably deflect with the movement of the displacer. Deflection and movement of sensitive SQUID devices greatly degrades their accuracy.

A need, therefore, exists for an improved cryocooler for cryogenically cooled devices having a low magnetic signature and reduced maintenance requirements.

SUMMARY OF THE INVENTION

The invention comprises a cryogenic refrigerator having a low magnetic signature which comprises a ceramic displacer and a rigid ceramic cold finger cylinder. The cold finger cylinder is substantially impenetrable to helium and the displacer is positioned to reciprocate within the cold finger cylinder.

An aspect of the preferred embodiment of the invention comprises a helium impenetrable coating deposited on the outer surface of the cold finger cylinder. A first layer of the coating comprises a silver mica binder while a second layer comprises copper. Further, a third layer comprising solder material may be deposited over the copper. This solder material is particularly useful for joining components to the cold finger cylinder.

In the preferred embodiment, the cryogenic refrigerator comprises a gap regenerator in which the outer surfaces of the displacer and the inner surfaces of the cold finger cylinder act as regenerative material for helium gas flowing through the refrigerator. The gap regenerator thereby formed comprises multiple stages of varying diameters.

The cryogenic refrigerator, or cooler, is specifically designed for cooling electronic devices and therefore further comprises a cold space which is cryogenically cooled. In the preferred embodiment, at least one thermal radiation shield is joined to the solder material of the ceramic cold finger cylinder in order to shield the cold space from thermal radiation. An electric motor which is used to drive the displacer and a compressor section is magnetically shielded from the cold space.

BRIEF DESCRIPTION OF THE DRAWINGS

The foregoing and other objects, features, and advantages of this invention will be apparent from the following more particular description of the preferred embodiment of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

The invention comprises an integral Stirling cryocooler with a low magnetic signature. The cryocooler is a low power, low output device which provides a magnetically undisturbed cold space 22 for electronic devices.

Figure 1:
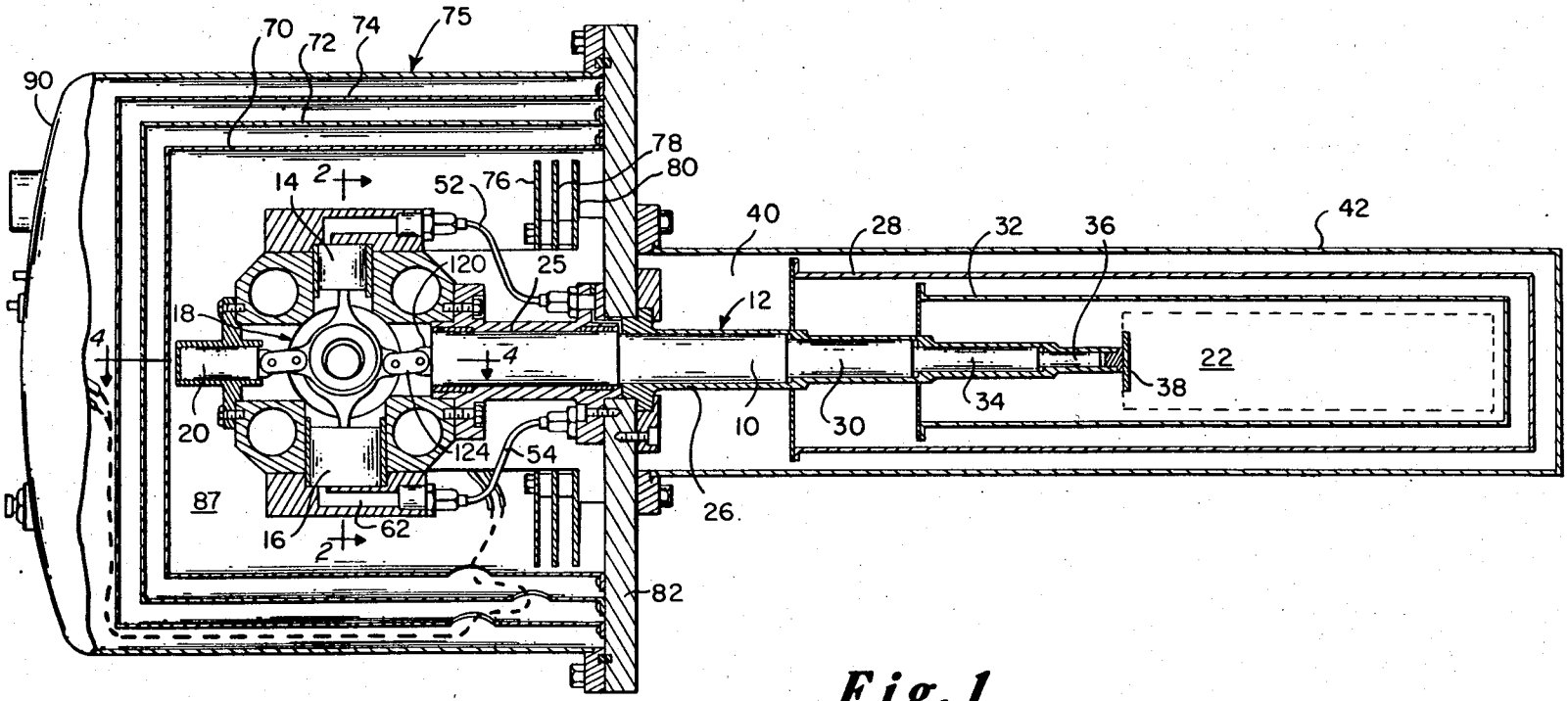
FIG. 1 is a longitudinal cross section of a cryocooler embodying the principles of the invention.

FIGS. 1 shows an integral Stirling cycle cryocooler which includes a refrigerator comprising a stepped displacer 10 positioned within a stepped, or cascaded, cold finger cylinder 12. The displacer 10 is driven by a motor and linkage to reciprocate inside the cold finger 12.

The displacer and cold finger are the critical parts of the Stirling machine which cool the cold space 22 to cryogenic temperatures. In this device, the cold finger displacer and cylinder are constructed of a machinable mica and boro-aluminosilicate glass ceramic. An example of such a material is Macor TM manufactured by the Corning Glass Works. Macor TM is a registered trademark of the Corning Glass Works.

One advantage of constructing the displacer and cylinder of ceramic material is to eliminate moving metallic components from the vicinity of the cold space 22. Moving metallic components set up magnetic fields in their vicinity. Such fields disrupt sensitive superconducting electronic devices and therefore must be avoided in any cryocooler for such devices.

Further advantages are gained by constructing these components of the machinable glass ceramic. Machinable ceramics are easily machined to the precise dimensions required and unlike most ceramics, they do not need to be fired or treated after machining. Therefore, once the ceramic components are machined, they are ready for use. Glass ceramics are much more rigid, therefore have much fewer flexing problems than Zimmerman's plastic device. Further, since both the displacer and the cold finger are constructed of the same material, thermal expansion and contraction of elements is consistent and, therefore, the refrigerator is not subject to seizing or unpredictability in the gap dimensions. The parts are machined to dimensions which produce the proper component clearances at the refrigerator's operating temperature.

The displacer 10 is supported to reciprocate in the cylinder 12 by the die post bearing 25. The die post bearing 25 radial clearance is extremely tight (less than 0.00015") in order to prevent the stepped displacer from rubbing on the stepped inner surface of the regenerative cold finger cylinder 12. This die post clearance allows the displacer to freely reciprocate within the cylinder with a 0.004 radial clearance at the refrigerator.

The cylinder and the displacer form a gap regenerator of four stages. Three compressor pistons 14, 15, 16 and the displacer 10 are driven by motor 18 in a harmonic relationship 90 degrees out of phase. This phase relationship allows helium gas to be compressed by the compressor pistons while the displacer dwells near the cold end of the cold finger (adjacent to the cold space 22). The compressor pistons then dwell while the displacer is moved toward the warm end of the refrigerator cooling the gas in the regenerative gap. During this part of the cooling cycle, heat energy is transferred into the ceramic walls of the displacer 10 and cylinder 12 to help cool the helium gas. Next, the displacer dwells near the warm end of the cold finger while the gas in the working volume is expanded by movement of the compressor pistons 14, 15, 16. The expansion of the gas in the cold end of the cold finger further cools the gas to produce useful refrigeration that maintains a substantial temperature gradient over the length of the cold finger cylinder 12. Finally, to complete the cycle, the compressor pistons dwell while the displacer returns to the cold end of the refrigerator, displacing the cold gas through the regenerative gap. The ceramic walls of the cold finger and displacer return the heat energy, previously transferred to them, to the gas. Most of this heat energy is then dissipated in the compressor section 75. In this way, a regenerative heat exchange is set up between the cylinder, the displacer and the helium gas.

Each successive stage of the stepped cold finger cylinder 12, moving from left to right in FIG. 1, is successively cooler. The first stage 26 operates at a temperature of about 180K at its junction with a first stage radiation shield 28. The second stage 30 operates at a temperature of about 80K at its junction with the second stage radiation shield 32. The third stage 34 operates at a temperature of about 30K at its junction with the fourth stage 36, which at its junction with the cold space 22 operates at a temperature of about 9–10K.

At the tip of the fourth stage 36, a short lead rod 38 forms a thermal damping block between the cold space 22 and the tip of the refrigerator 12. In order to minimize thermal changes which affect the operation of cryogenically cooled electronic devices, the damping block 38 minimizes the thermal oscillation between the cold tip 36 and the cold space 22. The damping block is designed to minimize the temperature drop between the cold tip and electronics in the cold space so that a device placed in the cold space will operate at cryogenic temperatures. Assuming a temperature variation of ±2° C. at the cold tip 36 of the cryogenic refrigerator, the dimensions of the damping block are set to provide sufficient thermal damping while having a temperature drop of only about 0.1° C.

Lead is a good material for a damping block since it has sufficient thermal conductivity and has a low thermal diffusivity. Lead is a diamagnetic material, above its superconducting transition temperature of 7.2K, and is therefore magnetically acceptable.

As mentioned above, the diffuser and cold finger are constructed of machinable glass ceramic. A problem with all plastics and ceramics is that they are somewhat permeable to helium gas. Helium molecules are extremely small, second only to hydrogen, and therefore readily penetrate virtually any material with the exception of metals. As mentioned above, metal components with motion in the earth's magnetic field cannot be used in the vicinity of the cold space without producing magnetic fields which disrupt magnetic measurements. In other non-metallic cryocoolers, helium gas eventually diffuses through the cold finger and into the surrounding chamber 40. A build-up of gas in the space 40 surrounding the cold finger will result in increased thermal transmission between the environment and the cold finger. This would produce a cold finger temperature rise and disrupt the operation of a device positioned in the cold space 22.

Helium penetration of critical ceramic components has been eliminated in this invention by plating the ceramic cold finger 12 with a very thin layer of metal. The metal layer is sufficiently thick so as to be impenetrable to helium but is also thin enough not to produce an unacceptable thermal conduction loss.

Plating ceramic material with a helium-tight coat of metallic material has required the development of a new plating process for ceramics. In this invention, a silver and mica binder is painted on the outer diameter of the cold finger. The cold finger with binder is then baked at 600° C. so that the binder diffuses into the ceramic. Since the ceramic used herein comprises primarily glass and mica, use of the silver mica binder produces a tight bond between the mica and the machinable ceramic cylinder. In addition, the binder's diffused silver allows subsequent plating to bond. The cold finger is then ready to be electrochemically plated with copper. The cylinder could be plated, however, with any good plating metal such as gold, silver or silver alloys. On top of the copper layer is plated a layer of solder material, such as tin, lead, antimony or indium. This top layer of solder material is particularly useful for forming good thermal conductive bonds. The plating and coating layers as a whole, however, should be less than 1 mil (0.001 inch) thick, otherwise the thermal conduction of the coating becomes large enough to adversely affect the refrigeration capacity. Since the displacer 10 is the moving component of the refrigerator and the cold finger cylinder 12 is stationary, this thin layer of metal does not produce a significant magnetic field.

The thinness of the metal coating is not a significant problem since only a few angstroms of metal is required to seal the cylinder to helium. A coated hollow cylinder of Macor TM ceramic has been successfully tested with helium gas pressurized in excess of 150 p.s.i. (interior pressure) and has held the helium without perceptible leakage.

The metallic coating of the cold finger is useful for mounting thermal radiation shields 28 and 32. The radiation shields 28, 32 may be soldered directly into the appropriate stages of the cold finger for good thermal conductivity. These radiation shields, which are analogous to those in conventional cryopumps, are cooled by the refrigerator and prevent thermal radiation from reaching the cold space 22. In addition, they act as cryoabsorption surfaces for any condensable gases found within housing 42.

The radiation shields are constructed of paramagnetic aluminum. Paramagnetic materials are those materials within which an applied magnetic field is slightly increased by an alignment of electron orbitals. The magnetic permeability of paramagnetic materials is very slightly greater than that of empty space. Since these aluminum components are stationary and are removed from the reciprocating displacer, and since vibration is minimized by design, they do not vibrate a great deal and do not seriously affect the magnetic field in the space 22.

Figure 2:
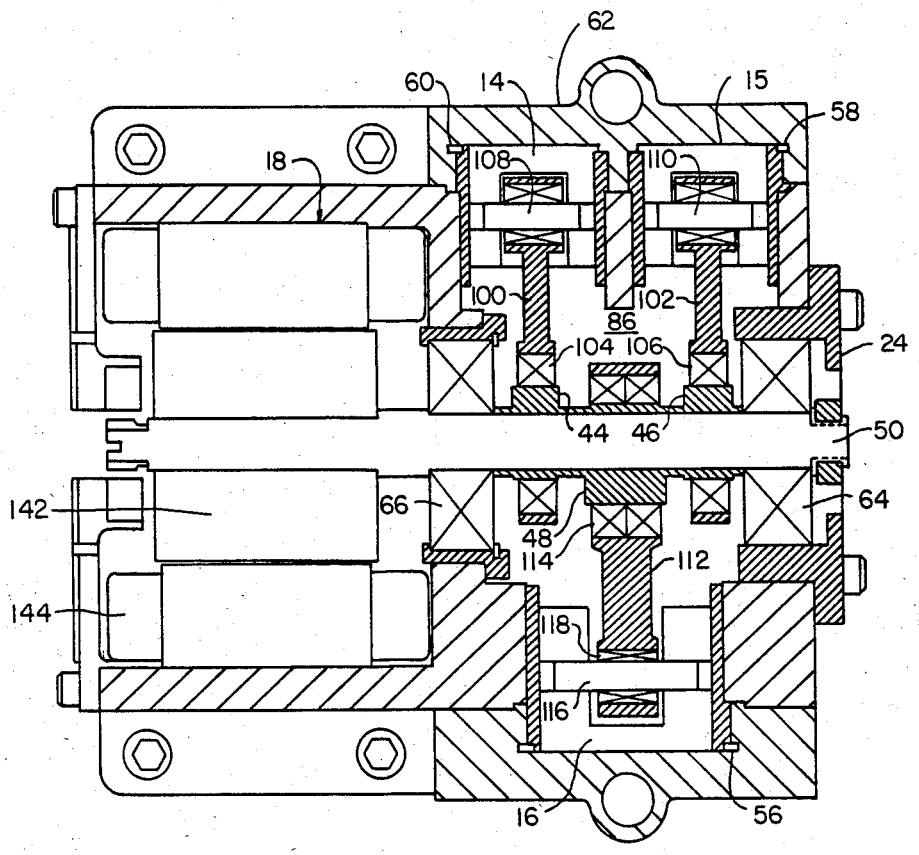
FIG. 2 is a transverse cross section of the cryocooler's compressor section taken along lines 2—2 of FIG. 1.
Figure 3:
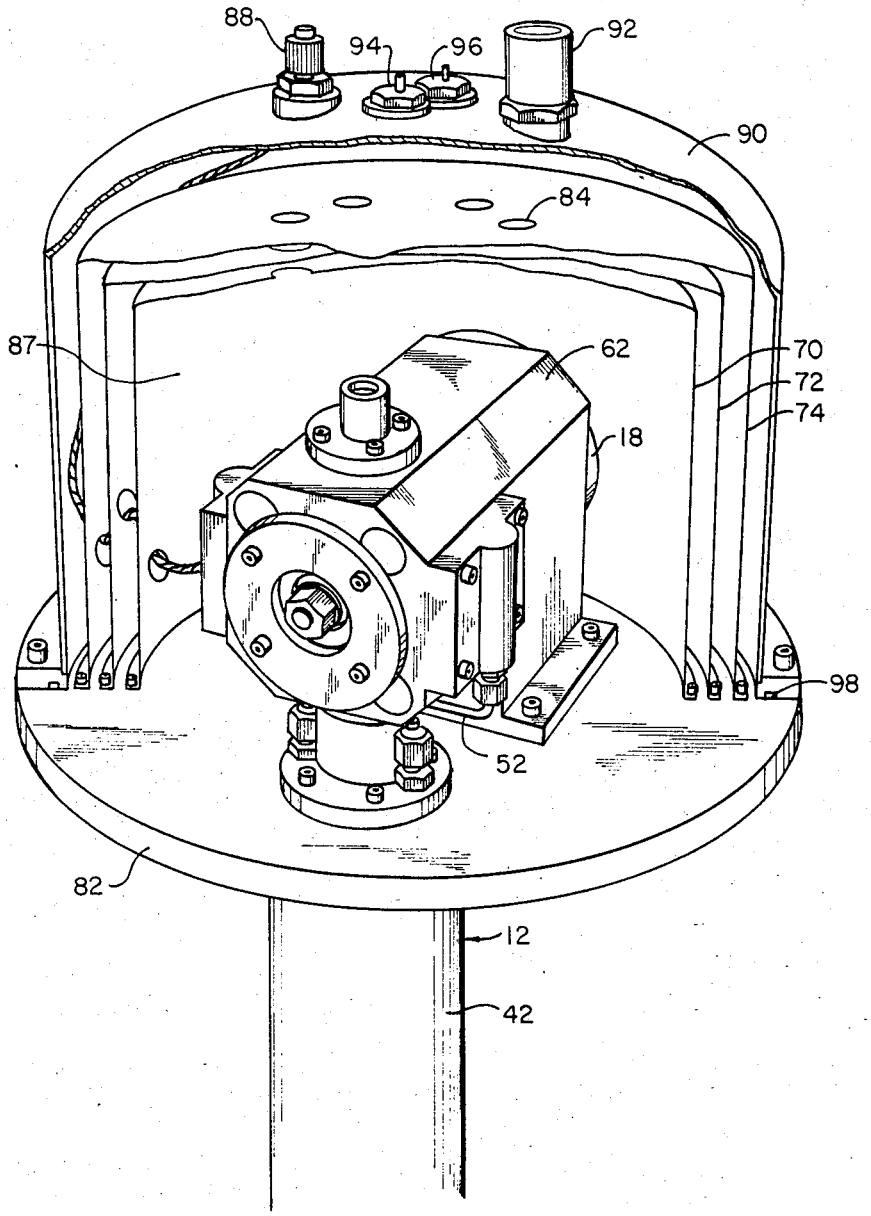
FIG. 3 is a perspective view of the cryocooler in which the compressor containment vessel has been partially broken away.

FIG. 2 is a cross section of the compressor section 75 shown in FIG. 1. FIG. 3 is a perspective view of the cryocooler embodying this invention. The description of the compressor section below, references all three figures.

The cryocooler is powered by an electric motor generally labeled 18. For sensitive devices such as would be placed in the cold space, it is most important to eliminate vibration and electrical magnetic interference. In order to eliminate vibration, the displacer and compressor assembly is carefully balanced by using opposing and counterbalanced masses.

The large compressor piston element 16 is pneumatically in phase with the small compressor piston elements 14 and 15. The eccentrics on which the piston elements ride are 180° out of phase in order to accomplish this. The small compressor pistons 14 and 15 are moved by respective eccentrics 44 and 46 which are in phase.

The compressor pistons 14 and 15 are attached to connecting rods 100, 102 through wrist pins 108, 110. The wrist pins are solidly attached to pistons 14 and 15 but oscillate within wrist pin bearings 108, 110. The connecting arms 100 and 102 ride on bearings 104 and 106 during the movement of eccentrics 44 and 46. Compressor piston 16 is similarly attached to eccentric 48 through bearing 114, connecting rod 112, wrist pin 116, and wrist pin bearing 118. As the motor shaft 50 rotates, the pistons 14, 15 and 16 compress and expand helium gas, and the helium pressure wave is transmitted through lines 52 and 54 (FIG. 1) to the gap between the displacer and the cold finger. The two small compressor pistons 14, 15 are sized to dynamically balance the large compressor piston. Since the twin compressor pistons 14, 15 are positioned on each side of the large piston 16 along the shaft, they also eliminate the primary moment on the shaft 50.

Figure 4:
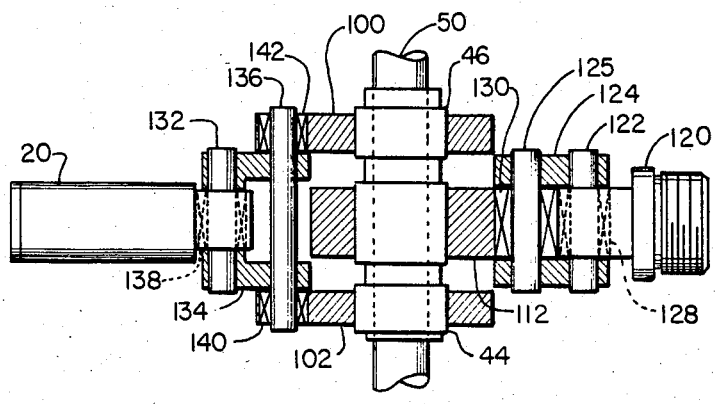
FIG. 4 is a cross section of the compressor section taken along lines 4—4 of FIG. 1.

FIG. 4 is a cross sectional view of the motor shaft 50 and displacer joint. The displacer 10 is rotatably attached to connector base 120. The base is connected to the shaft 50 on an axis perpendicular to the cross sectional view of FIG. 2. This ensures that the displacer reciprocates 90° out of phase with the compressor so that the refrigerator operates on a Stirling cycle. Base 120 is attached through pin 122, connecting link 124 and pin 126 to connecting arm 112 which also supports compressor piston 16. Small bearings 128, 130 allow the pins to oscillate within the base 120 and the connecting link 124.

In order to dynamically balance the motor shaft 50, a dummy displacer 20 is mounted through eccentrics 44 and 46 on an axis 90° out of the cross section of FIG. 2. Pin 132, connecting link 134, and pin 136 are used to connect the dummy displacer to connecting rods 100 and 102 which ride on eccentrics 44 and 46. The displacer pins 132 and 136 oscillate with the movement of the displacer in small bearings 138, 140, and 142. Since the dummy displacer is positioned to reciprocate 180° out of phase with the refrigerator displacer 10 and is connected to both eccentrics 44 and 46 on each side of displacer eccentric 48, it both balances the shaft 50 for displacer movement and eliminates the primary moment on the shaft.

The compressor motor environment, or crankcase 86, is filled with helium. O-rings 56, 58 and 60 serve to seal the compressor working fluid helium within the compression area so as to limit communication of pressurized helium between the compression chamber and crankcase.

A pressure dome 90 has an O-ring seal 98 with the base plate 82 in order to prevent helium leakage from the compressor pressure dome volume 87 and the crankcase 86. Valve 88 on the pressure dome 90 is used for charging the dome with helium gas. The pressure dome volume 87 is allowed to freely communicate with the crankcase volume 86 through motor shaft bearings 64, 66. Site 92 can be used for an optional pressure gauge to monitor cryocooler integrity. Terminals 94 and 96 are used to connect the electronic control to the DC brushless motor 18.

The crankcase pressure is equal to the mean pressure of the helium pressure wave generated by the compressor pistons. Therefore, the compressor pressure wave alternates between being slightly lower and slightly higher than the crankcase pressure. This reduces the load on the compressor pistons to the minimum required to generate the pressure wave. Further, any minor communication of helium between the compressor and crankcase will not affect compressor performance because the crankcase pressure tends to reestablish the mean compressor pressure.

Referring now to FIGS. 2 and 3, one can see the electric motor 18 in detail. The electric motor comprises the shaft 50, a permanent magnet armature 142, coils 144 and an electronic control (not shown). The motor shaft 50 is supported by two bearings 64 and 66. The electric motor is a DC brushless motor which has several advantages in this application. DC brushless motors tend to produce less sparking and electromagnetic interference than conventional electric motors. In this application, it is a great advantage to reduce this interference so as to minimize magnetic disruption of the cold space.

DC brushless motors, however, do generate some magnetic interference with their magnetic fields coupled with their metallic rotating parts and therefore must be shielded from the cold space. A series of magnetic shields 70, 72, 74, 90 enclose the motor 18 on three sides. Further, on the fourth side a series of shields 76, 78, 80, and a lining on the base plate 82 reduce interference leakage in the direction of the cold finger. The magnetic shields are constructed of material with a high magnetic permeability. An example is commonly used material of this type is Mu shield TM sold by the Mu shield Co., a division of Bomco Inc., 121 Madison St., Malden, Mass. 02148. Mu shield TM is a registered trademark of Bomco, Inc. This material, due to its high magnetic permeability, restricts the magnetic interference of the motor 18 to within the confines of the shields except for very small leakages from access holes. Pressure equalization holes 84 are supplied in shields 70, 72 and 74 as shown in FIG. 3.

A small amount of the magnetic interference may escape the compressor section 75 through the ceramic displacer 20 which cannot be used to shield the motor. Magnetic interference escaping through this gap in the shielding is attenuated by the distance between the motor and the cold space. According to the laws of electromagnetism, magnetic fields decline geometrically with distance from the source. Since the source is minimized to one small location, it has been found that the small amount of magnetic interference which leaks through is effectively attenuated by distance before it reaches the cold space 22. The refrigerator mounting plate 82 also serves to reduce magnetic interference from the motor.

While the invention has been particularly shown and described with reference to the preferred embodiment thereof, it will be understood by those skilled in the art that various changes in form and detail may be made without departing from the spirit and scope of the invention as defined in the appended claims. For example, ceramic displacer and cold finger cylinder may be easily adapted to a split Stirling cryocooler. In a split Stirling machine, the compressor and associated motor can be at a remote location from the cold finger refrigerator. The helium pressure wave is conducted through a small tube to the refrigerator from the compressor. There are several disadvantages with split Stirling machines relating to timing of the compressor and displacer, but these may be overcome. Further, metal coated glass ceramic is useful for other components in helium and gas handling devices.

We claim:

1. A cryogenic refrigerator comprising a gap regenerator which comprises:

a support member adapted to serve as a radiation shield;

a drive member extending through the support member;

a ceramic displacer driven by the drive member;

a vacuum tight rigid cermaic cold finger which is substantially helium impenetrable supported by the support member and surrounding the displacer and forming a gap regenerator therewith;

a dome supported by the support member on the side thereof opposite to the cold finger, the dome forming a vacuum vessel and serving as a high magnetic permeability radiation shield;

counterbalance rotary-to-linear electromagnetic drive means within the dome for driving the displacer driver member;

a plurality of dome-like high magnetic permeability radiation shields supported by the support member and surrounding the electromagnetic drive means; and a plurality of radiation shields surrounding the displacer driver member and positioned between the support member and the electromagnetic drive means.

2. A cryocooler for cooling electronic devices to cryogenic temperatures having a low magnetic signature which comprises:

electromagnetic drive means;

a compressor driven by the electromagnetic drive means;

a ceramic displacer driven by the electromagnetic drive means;

a ceramic cold finger cyclinder wherein the outer surface of said cold finger cylinder comprises a non-porous metallic coating and wherein the inner surface of said cold finger cyclinder reciprocally receives said displacer to form a gap regenerator for cooling said cold finger;

a plurality of dome-like high magnetic permeability radiation shields surrounding the electromagnetic drive means and the compressor but open toward the displacer; and a plurality of high magnetic permeability radiation shields surrounding a drive member between the electromagnetic drive means and the displacer.

3. The crycooler for cooling electronic devices described in claim 2 further comprising:

at least one thermal radiation shield joined to the ceramic cold finger cylinder and surrounding a cold space for the placement of said electronic devices adjacent to said cold finger.

4. The cryocooler of claim 3 further comprising a thermal damper positioned between said cold finger and cold space.

5. A cryogenic refrigerator comprising:

a cold space for mounting an electronic device;

a machinable glass ceramic displacer;

a machinable glass ceramic cold finger surrounding said displacer wherein said cold finger is metal coated to form a helium sealed environment for said displacer of low magnetic signature;

drive means for moving said displacer within said cylinder;

a plurality of dome-like high permeability magnetic radiation shields surrounding the electromagnetic drive means but open toward the displacer; and a plurality of high permeability magnetic radiation shields surrounding a drive member between the electromagnetic drive means and the displacer.

6. The cryogenic refrigerator of claim 5 wherein said drive means comprises a brushless direct current electric motor.

7. The cryogenic refrigerator of claim 6 wherein said motor operates in a sealed housing.

8. The cryogenic refrigerator of claim 5 wherein said drive means comprises an electric motor having a rotating shaft and said shaft is counterbalanced to reduce vibration.

9. The cryogenic refrigerator of claim 5 further comprising a superconducting electronic device adjacent to said cold finger.

* * * * *